US006911945B2

(12) United States Patent
Korva

(10) Patent No.: US 6,911,945 B2
(45) Date of Patent: Jun. 28, 2005

(54) MULTI-BAND PLANAR ANTENNA

(75) Inventor: Heikki Korva, Kempele (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/771,230

(22) Filed: Feb. 2, 2004

(65) Prior Publication Data

US 2004/0169611 A1 Sep. 2, 2004

(30) Foreign Application Priority Data

Feb. 27, 2003 (FI) ..... 20030296

(51) Int. Cl.[7] ..... H01Q 1/24

(52) U.S. Cl. ..... 343/702; 343/700 MS; 343/767

(58) Field of Search ..... 343/700 MS, 702, 343/767, 770, 829, 846

(56) References Cited

U.S. PATENT DOCUMENTS 6,408,190 B1 6/2002 Ying
6,448,932 B1 9/2002 Stoiljkovic et al.
6,466,170 B2 * 10/2002 Zhou ..... 343/700 MS
6,529,168 B2 * 3/2003 Mikkola et al. ..... 343/702
6,573,869 B2 * 6/2003 Moore ..... 343/702
6,670,923 B1 * 12/2003 Kadambi et al. .... 343/700 MS
6,806,834 B2 * 10/2004 Yoon ..... 343/702
2002/0003499 A1 1/2002 Kouam et al.

FOREIGN PATENT DOCUMENTS

EP 1 096 602 A1 5/2001
EP 1 128 466 A2 8/2001
EP 1 202 386 A2 5/2002
EP 1 248 317 A1 10/2002
WO WO-02/078124 A1 10/2002

* cited by examiner

*Primary Examiner*—Tho Phan
(74) *Attorney, Agent, or Firm*—Darby & Darby

(57) ABSTRACT

A multi-band planar antenna applicable as an internal antenna in small-sized mobile stations, and to a radio device including an antenna according to the invention. The basis is a conventional dual band PIFA with its feeding and shorting conductors and a non-conducting slot. The planar element (220) has a second slot (232) known as such, which starts at the edge of the planar element on the other side of the feeding conductor (221) and shorting conductor (211) than the above-mentioned slot (231). In addition the structure comprises a second shorting conductor (212) on the other side of the second slot, than the feeding conductor. The second slot acts as a radiator, which for instance broadens the upper band of a dual band antenna. The second shorting conductor facilitates a better matching of a multi-band antenna than in corresponding prior art antennas. The antenna is simple, and its manufacturing costs are relatively low.

5 Claims, 3 Drawing Sheets

MULTI-BAND PLANAR ANTENNA

The invention relates particularly to a multi-band planar antenna, which is applicable as an internal antenna in small-sized mobile stations. The invention relates also to a radio device including a planar antenna according to the invention.

BACKGROUND OF THE INVENTION

Mobile communications traffic is distributed over frequency bands used by several radio systems, such as different GSM systems (Global System for Mobile telecommunications). Therefore such models that operate in at least two radio systems are common among the mobile stations. The multi-band ability means of course that the design of the mobile terminals antenna will be more difficult. The design process becomes still more difficult if the antenna must be placed within the cover of the device to provide convenient use.

An antenna, which is located within a small-sized radio device and which has sufficiently good radiation and receiving characteristics, is most easily realised as a planar structure: the antenna comprises a radiating plane and a ground plane, which is parallel to the radiating plane. In order to facilitate the matching the radiating plane and the ground plane are usually interconnected at a suitable point by a shorting conductor, which creates a structure of the PIFA type (Planar Inverted F-Antenna). In principle it is possible to increase the number of operating bands by dividing the radiating plane with the aid of non-conducting slots into branches, which seen from the shorting point, have different lengths, so that the resonance frequencies of the antenna parts corresponding to the branches will be located at the desired frequency bands. However, then it is problematic to obtain the antenna matching and to get a sufficient bandwidth, at least at some of the bands. In a planar antenna a new operating band can be obtained also by using a slot radiator. Also in this case a non-conducting slot is made in the radiating planar element. The end of the slot, which opens to the edge of the planar element, is relatively close to the feeding point of the antenna. If further the length of the slot is suitable, then an oscillation is excited at the desired frequency. In the case of a two-band antenna the slot resonates for instance at the upper operating band and the conducting plane at the lower operating band.

The provision of a sufficient bandwidth or bandwidths may be problematic also using a slot radiator. One solution is to increase the number of the antenna elements: an electromagnetically connected, i.e. parasitic planar element is located close to the radiating plane proper. Its resonance frequency is arranged to be close to the resonance frequency for instance of the slot radiator, so that there is formed a uniform and relatively wide operating band. Disadvantages in using parasitic elements are that they require space, increase the production costs for the antenna and reduce the reproducibility in the production. In a corresponding manner the resonance frequency of a slot radiator and the upper resonance frequency of the two-band PIFA can be arranged close to each other, so that there is formed an uniform, relatively wide operating band. In that case the radiating plane has two slots: one slot in order to form a two-band PIFA and a second slot to form the slot radiator.

From the application publication FI20012045 there is known a planar antenna structure shown in FIG. 1. It has a ground plane 110 and a rectangular radiating planar element 120 supported above the ground plane by a dielectric frame 170. The antenna's feeding point F and the shorting point S are located at the edge of the planar element 120, on one long side. The first slot 131 of the planar element starts at the same edge, on the farther side of the feeding point, as seen from the shorting point. This first slot is arranged to operate as a radiator in the manner described above. The most substantial feature of the antenna is that now the planar element 120 in addition has a second slot 132 that starts from the edge of the plane element between the feeding and shorting points and ends at the inner region of the plane. The antenna is a dual-band antenna, and it has three resonances, which are substantial regarding its operation: the planar element 120 has a conductor branch B1, which starts from the shorting point S and extends around the end of the first slot 131, and which together with the ground plane forms a quarter-wave resonator, operating as a radiator on the lower operating band of the antenna. The first slot together with the surrounding conductor plane and the ground plane resonates and operates as a radiator on the upper operating band of the antenna. The second slot 132 is also dimensioned so that it together with the surrounding conductor plane and the ground plane forms a quarter-wave resonator operating as a radiator on the upper operating band of the antenna. The resonance frequencies of the two slot radiators can be chosen so that the upper operating band will be very wide. It extends well over the frequency bands of for instance the GSM1800 and GSM1900 systems. At the edge of the planar element, on the short side closest to the shorting point S there is extension 125 being directed towards the ground plane, which extension improves the matching of the second slot radiator and also the plane radiator.

In the structure according to FIG. 1 the exceptionally wide upper band is obtained particularly with the aid of the slot extending between the feeding and shorting points. A disadvantage of this structure is that said arrangement impairs the matching of the antenna on the lower operating band, particularly when the aim is an antenna with a minimal size.

SUMMARY OF THE INVENTION

The object of the invention is to realize an internal plane antenna having at least two operating bands in a new way. The planar antenna according to the invention is characterised in what is presented in the independent claim 1. A radio device according to the invention is characterised in what is presented in the independent claim 5. Some advantageous embodiments of the invention are presented in the dependent claims.

The basic idea of the invention is as follows: The basis is an ordinary dual-band PIFA with its feeding and shorting conductors, in which PIFA the radiating plane has two conductor branches of different lengths, which are separated by a non-conducting slot. The planar element has a second slot known as such, which starts from the edge of the plane, on the other side of the feeding conductor and shorting conductor than the slot mentioned above. In order to match the antenna the structure further comprises a second shorting conductor on the other side of the second slot than the feeding conductor. The second slot acts as a radiator, which for instance broadens the upper band of a dual-band antenna.

An advantage of the invention is that due to the second shorting conductor the matching of a multi-band planar antenna is better accomplished than in corresponding antennas of prior art. This can be utilised by constructing a smaller antenna. A further advantage is that an antenna according to the invention is simple and advantageous to manufacture. However, the second shorting conductor means an extra cost, but on the other hand it is possible to omit matching parts of known antennas.

BRIEF DESCRIPTION OF THE DRAWINGS

Below the invention is described in detail. In the description reference is made to the enclosed drawings, in which.

DETAILED DESCRIPTION OF THE INVENTION

Figure 2:
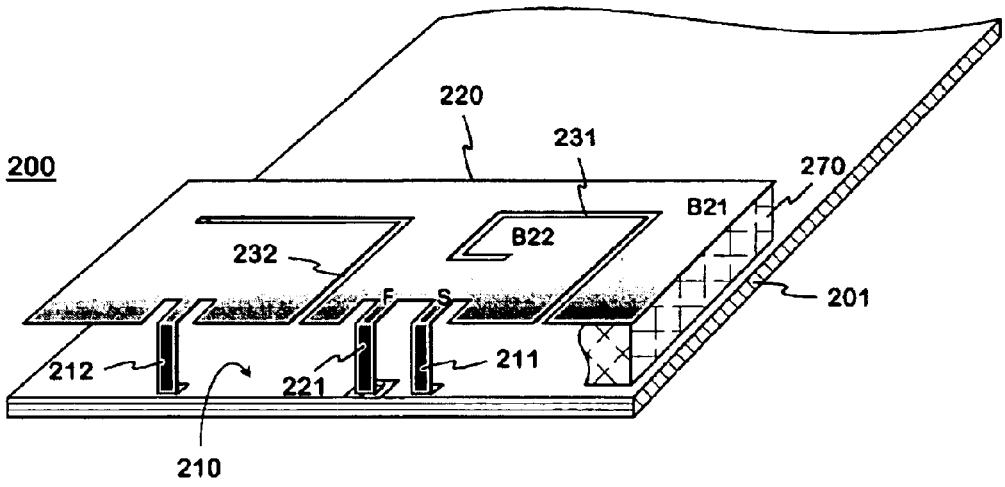
FIG. 2 shows an example of a planar antenna according to the invention.

FIG. 2 shows an example of a planar antenna according to the invention. The figure shows the circuit board 201 in a radio device where the top conductive surface of the circuit board acts as the ground plane 210 of the antenna 200. A radiating planar element 220 lies above the ground plane, supported by a dielectric frame 270 on the circuit board. On one side of the planar element the antenna feeding conductor 221 is joined to it in the feeding point F and the first shorting conductor 211 in the shorting point S. In this example these conductors are of the same metal sheet with the planar element. The lower end of the shorting conductor 211 abuts of course the ground plane on the top surface of the circuit board 201. The lower end of the feeding conductor 221 seen in the figure also abuts the circuit board, but isolated from the ground it extends via a through hole to the antenna port of the radio device. The planar element 220 has a first slot 231, which is open at the element's edge on the same side where the feeding and first shorting conductors are located. Seen from the front corner of the planar element along said edge there is first the open end of the first slot, then the shorting conductor 211, and then the feeding conductor 221. The first slot divides the planar element, as seen from the shorting point S, into a first branch B21 and a second branch B22. The first branch together with the ground plane forms a quarter-wave resonator and acts as a radiator at the first operating band of the antenna, this band being the lower operating band in this example. The second branch B22 together with the ground plane forms a quarter-wave resonator and acts as a resonator at the second operating band of the antenna, which in this example is the upper operating band. The planar element 220 includes further a second slot 232, which also opens at the element's edge, on the same side where the feeding and shorting conductors are located. Both the feeding point F and the shorting point S remain in the area between the first and second slots. The second slot 232 can be located and dimensioned so that it together with the surrounding conducting plane and the ground plane forms a quarter-wave resonator and acts as a radiator on the second, upper operating band of the antenna.

Figure 1:
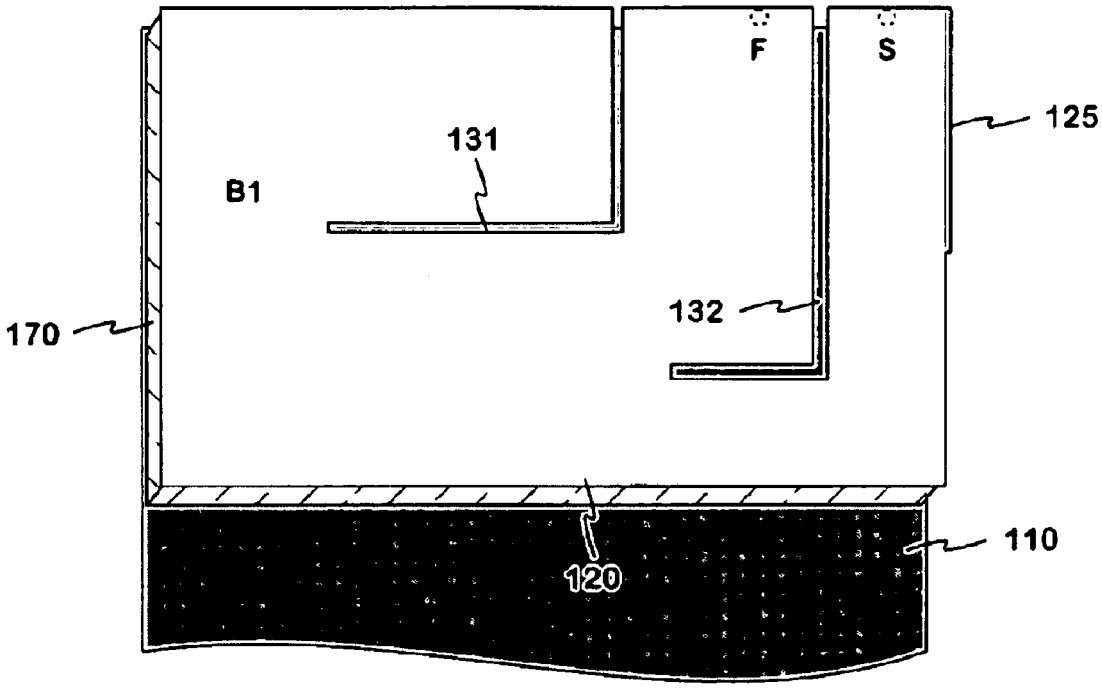
Fig. 1 PRIOR ART
FIG. 1 shows an example of a prior art planar antenna.

The planar antenna of FIG. 2 further comprises a second shorting conductor 212 according to the invention. This is joined to the planar element on the same side as the feeding and the first shorting conductors. The joining point, seen from the feeding point F, is on the farther side of the second slot 232; thus the second slot extends between the joining points of the antenna feeding conductor and the second shorting conductor. By the second shorting conductor the matching of the antenna is improved. The effect on the matching depends on the location of the shorting, as is always the case when using shorting conductors. By selecting the location of the second shorting conductor the improved matching can be directed mainly either to the lower or upper operating band in the case of a dual-band antenna. As an advantage the invention provides particularly an improved operation of the antenna at the lower operating band. An improvement at the lower operating band compared to the structure shown in FIG. 1 is achieved already by the fact that now the radiating slot does not pass between the feeding point and the first or primary shorting point S. A primary shorting point is required for the antenna to be serviceable at all.

Figure 3:
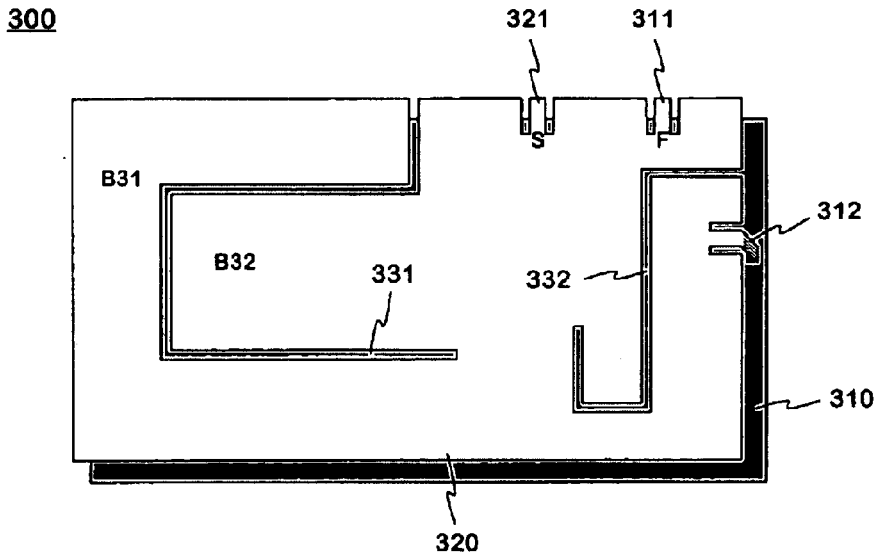
FIG. 3 shows another example of an antenna according to the invention.

FIG. 3 shows another example of a planar antenna according to the invention. The figure shows the radiating planar element 320, as seen from above, and the ground plane 310 below this element. At the edge of the plane element, at the second long side, there is partly shown the antenna feeding conductor 321 joined to the planar element at the feeding point F, and the first shorting conductor 311 joined to the planar element at the shorting point S. The planar element 320 has a first slot 331, which divides the planar element into a first radiating branch B31 and a second radiating branch B32, as seen from the shorting point S. Now the second shorting conductor 312 according to the invention is located on the adjacent side of the planar element, compared to the location of the feeding conductor and the first shorting conductor. The second radiating slot 332 in the planar element is open to the edge of the planar element on the same short side where the second shorting conductor 312 is located. The feeding point F and the shorting point S are located in the area between the first and second slots, and the second slot extends between the feeding point and the joining point of the second shorting conductor, as in the structure shown in FIG. 2.

Figure 4:
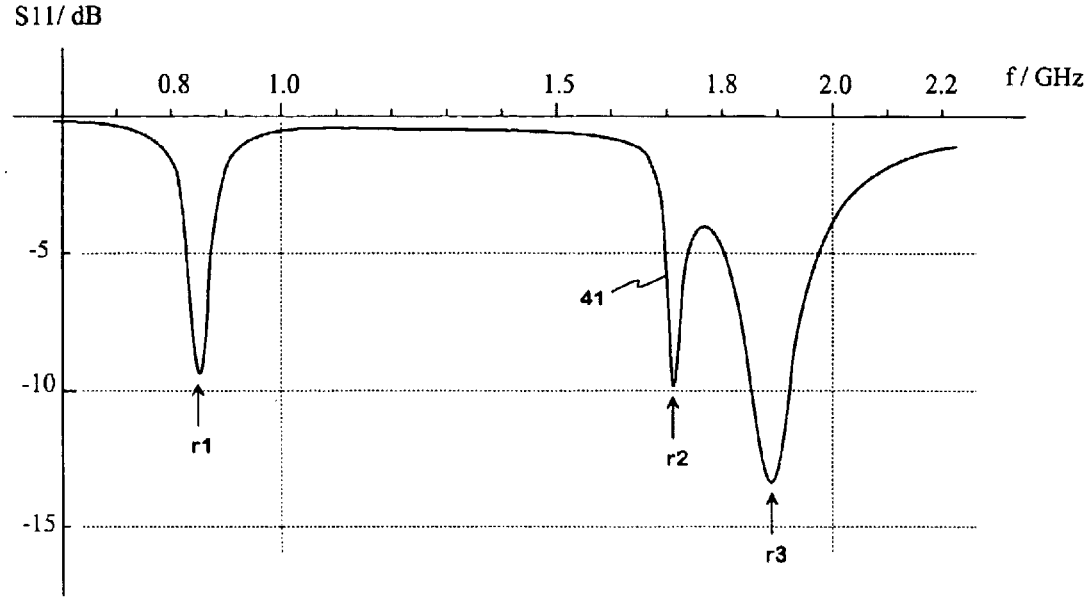
FIG. 4 shows an example of the band characteristics of an antenna according to the invention.

FIG. 4 shows an example of the frequency characteristics of an antenna according to the invention. The figure shows the curve 41 of the reflection coefficient S11 as a function of the frequency. It is measured for an antenna, which is similar to that shown in FIG. 2. The smaller the reflection coefficient, the better the antenna will transmit and receive radio waves. Each minimum in the curve of the reflection coefficient corresponds to a resonance state of the antenna. From curve 41 can be seen that the measured antenna has three significant resonances. The lowest resonance r1 at the frequency 850 MHz is due to the longer conductor branch of the planar element, and the highest resonance r3 at 1.9 GHz is due to the shorter conductor branch of the planar element. The middle resonance r2 at the frequency 1.72 GHz is due to the radiating slot of the planar element. The operating band based on the lowest resonance covers the frequency range used by the GSM850 system. The middle and the highest resonance are arranged so that they form an uniform operating band over the range 1.7 GHz to 2.0 GHz, using a reflection coefficient value of −4 dB as the criterion of the cut-off frequency. This operating band covers the frequency ranges used by both the GSM1800 and the GSM1900 systems.

Figure 5:
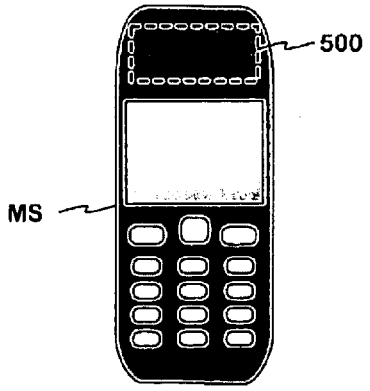
FIG. 5 shows an example of a radio device provided with an antenna according to the invention.

FIG. 5 shows a radio device MS containing a planar antenna 500 according to the invention. The whole antenna is located within the cover of the radio device.

Above we described a multi-band planar antenna according to the invention. The invention does not restrict the shape of the antenna's planar element to the above described shapes. In the examples two of the antenna resonances have been used to form one wide operating band. Quite similarly in the case of three resonances it is possible to form three different operating bands. The invention will also not limit the manufacturing method of the antenna, nor the materials used in it. The inventive idea can be applied in different ways within the limits set by the independent claim 1. The claims mention resonating conductor branches and slots for the sake of brevity. Then it is meant, however, a resonating entity, which in addition to said branch or slot comprises i.a. the ground plane and the space between the ground plane and the radiating plane.

What is claimed is:

1. A planar antenna having at least a first and a second operating band and comprising a ground plane and a radiating planar element with an antenna feeding point and a shorting point, a first slot opening at an edge of the planar element, the first slot dividing the planar element into a first and a second radiating branch as seen from the shorting point, and a radiating second slot opening at an edge of the planar element so that the feeding point and the shorting point remain in an area between the first and second slots, wherein, to improve matching of the antenna, the planar antenna further comprises a second shorting conductor being located on the other side of the open end of the second slot from the feeding point.

2. A planar antenna according to claim 1, the first radiating branch being arranged to resonate at the first operating band of the antenna, and the second radiating branch being arranged to resonate at the second operating band of the antenna.

3. A planar antenna according to claim 2, said second slot being arranged to resonate at the second operating band of the antenna.

4. A planar antenna according to claim 2, further having a third operating band, and said second slot being arranged to resonate at the third operating band.

5. A radio device with a planar antenna having at least a first and a second operating band, which antenna comprises a ground plane and a radiating planar element with an antenna feeding point and a shorting point, a first slot opening at an edge of the planar element, the first slot dividing the planar element into a first and a second radiating branch as seen from the shorting point, and a radiating second slot opening at an edge of the planar element so that the feeding point and the shorting point remain in an area between the first and the second slots, wherein, to improve antenna matching, the planar antenna further comprises a second shorting conductor being located on the other side of the open end of the second slot from the feeding point.

* * * * *